US009225092B2

(12) United States Patent
Kojima et al.

(10) Patent No.: US 9,225,092 B2
(45) Date of Patent: Dec. 29, 2015

(54) TERMINAL AND METHOD OF FORMING CAP OF TERMINAL

(75) Inventors: Hiroshi Kojima, Makinohara (JP); Shinichi Saeki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 63 days.

(21) Appl. No.: 14/126,887

(22) PCT Filed: May 31, 2012

(86) PCT No.: PCT/JP2012/064041

§ 371 (c)(1),
(2), (4) Date: May 19, 2014

(87) PCT Pub. No.: WO2012/176597

PCT Pub. Date: Dec. 27, 2012

(65) Prior Publication Data

US 2014/0295716 A1 Oct. 2, 2014

(30) Foreign Application Priority Data

Jun. 20, 2011 (JP) ..... 2011-135976

(51) Int. Cl.
*H01R 13/64* (2006.01)
*H01R 13/04* (2006.01)
(Continued)

(52) U.S. Cl.
CPC ..... *H01R 13/04* (2013.01); *H01R 43/16* (2013.01); *H01R 4/22* (2013.01); *Y10T 29/49204* (2015.01)

(58) Field of Classification Search
CPC ..... H01R 23/7005; H01R 13/629; H01R 13/631; H01R 13/64
USPC ..... 439/378
See application file for complete search history.

(56) References Cited

U.S. PATENT DOCUMENTS 6,149,472 A 11/2000 Endo et al.
6,159,046 A * 12/2000 Wong ..... H01R 43/22 439/578
6,179,656 B1 * 1/2001 Wong ..... H01R 9/0518 439/578

(Continued)

FOREIGN PATENT DOCUMENTS

EP 0791985 A1 8/1997
EP 1209772 A2 5/2002

(Continued)

OTHER PUBLICATIONS

Supplementary European Search Report dated Feb. 12, 2015, issued for the European patent application No. 12802371.0.

(Continued)

*Primary Examiner* — Abdullah Riyami
*Assistant Examiner* — Thang Nguyen
(74) *Attorney, Agent, or Firm* — Locke Lord LLP; James E. Armstrong, IV; Brian S. Matross

(57) ABSTRACT

Disclosed are a terminal allowing work for attaching the cap to the insertion part to eliminate, and to provide in a short time the cap to the insertion part, and a method of forming the cap of the terminal. In a terminal, at a tip end of a tubular insertion part a resin made cap is provided, the insertion part includes an annular portion with narrower diameter than that the insertion part at a tip end thereof, the cap is disposed at the insertion part by a dipping work covering the annular portion in an inner side away from a tip end of the insertion part past the annular portion.

2 Claims, 4 Drawing Sheets

(51) Int. Cl.
*H01R 43/16* (2006.01)
*H01R 4/22* (2006.01)

(56) References Cited

U.S. PATENT DOCUMENTS 6,352,448 B1 * 3/2002 Holliday ..... H01R 9/0521 439/585
6,361,364 B1 * 3/2002 Holland ..... H01R 4/4818 439/578
6,805,583 B2 * 10/2004 Holliday ..... H01R 9/0524 439/578
6,963,780 B2 * 11/2005 Ruben et al. ..... 607/36
2004/0248476 A1 12/2004 Zhang

FOREIGN PATENT DOCUMENTS

JP 2000-091014 A 3/2000
JP 2003-017168 A 1/2003

OTHER PUBLICATIONS

International Search Report dated Jul. 10, 2012, issued for PCT/JP2012/064041.

* cited by examiner

TERMINAL AND METHOD OF FORMING CAP OF TERMINAL

TECHNICAL FIELD

This invention relates to terminals with cap to be attached to terminals of electric wires and methods of forming caps of terminals.

BACKGROUND ART

Automobiles have various types of electric devices mounted thereto. To apply power or control signals to the electric devices, wire harnesses are used. The wire harnesses are provided with electric wires and connectors.

The connector is provided with a terminal including a terminal fitting attached to a distal end of the electric wire and a cap attached to a distal end of the terminal fitting, and a housing accommodating the terminal and provided with a terminal housing (see PTL 1 for example)

FIG. 7 is a cross-sectional view illustrating a conventional terminal. FIG. 8 is a perspective view illustrating the terminal shown in FIG. 7. The forgoing conventional terminal 101 is provided with a terminal fitting 102, and a cap 106.

The foregoing conventional terminal fitting, or a male terminal fitting 102 is as shown in FIGS. 7 and 8, provided with a insertion part 103 to be connected to a mating female terminal fitting (not-shown), and a electric wire connection part 105 to be connected to the electric wire 10. Also, the terminal fitting 102 is made by punching or bending a metal plate. The terminal fitting 102 is inserted into the terminal housing from the insertion part 103.

The insertion part 103 is made such by roll-forming punched metal. Namely, the insertion part 103 is formed cylindrical. The insertion part 103 is provided with an opening 102*a* (shown in FIG. 8) at an end away from the electric wire connection part 105, i.e., a tip of the terminal fitting 102.

The cap 106 is provided with a cylinder-like shaft 161 to be inserted into the insertion part 103, and a head 162 disposed at an end of the shaft 161 having larger diameter than the shaft 161. The cap 106 is made of synthetic resin. The cap 106 is inserted into inside the insertion part 103 along a length direction N (shown in FIG. 8) of the terminal fitting 102. Also, the cap 106, when the terminal 101 is inserted into the terminal housing of the housing 101, is attached for preventing the insertion part 103 of the terminal fitting 102 from damaging an inner wall of the terminal housing. Also, the cap 106, when the insertion part 103 is inserted into an electric wire contact part of the female terminal fitting, is attached for preventing the insertion part 103 from damaging an inner wall of the electric wire contact part of the female terminal fitting.

When the foregoing cap 106 is attached to the insertion part 103, adhesive 109 is preliminarily applied to an outer peripheral face of the shaft 161 of the cap 106, the shaft 161 to which the adhesive 109 is applied is inserted from the insertion inlet 102*a* into the insertion part 103. Thus, the cap 106 is attached to the insertion hole 103.

CITATION LIST

Patent Literature

[PTL 1]
Japanese Patent Application Laid-Open Publication No 2000-91014

SUMMARY OF INVENTION

Technical Problem

Disadvantageously, the conventional terminal 101 posed drawbacks to be mentioned. Namely, it is difficult that in the terminal 101 the adhesive 109 is uniformly applied to the shaft 161 of the cap 106, and that the cap 106 can be secured to the terminal fitting 102. Also, it takes time that the adhesive 109 is uniformly applied to the shaft 161 of the cap 106, and thereby the time required until the cap 106 is attached to the terminal fitting 102 may become long.

This invention is to resolve the foregoing drawbacks. Namely, the invention is to provide a terminal capable of eliminating work for attaching a cap to an insertion part, providing in a short time the cap to the insertion part, and a method of forming the terminal.

Solution to Problem

According to one aspect of the invention, there is provided a terminal, including: a tubular insertion part including an annular portion with narrower diameter than the insertion part disposed at a tip end of the insertion part; and a resin made cap disposed at the tip end of the insertion part by a dipping work covering the annular portion to an inner side away from the tip end the insertion part past the annular portion.

According to another aspect of the invention, there is provided a method of forming a cap of a terminal, comprising the steps of: providing an annular portion with narrower diameter than a tubular insertion part at a tip end of the insertion part; and providing the cap on the insertion part by a dipping work covering the annular portion to an inner side from the tip end of the insertion part past the annular portion.

Preferably, the annular portion is formed by pressing the insertion part radially.

Advantageous Effects of Invention

According to the one aspect of the invention, since in the terminal in which the resin made cap is provided with the tip of the annular insertion part, the insertion part includes the annular portion with narrower diameter than the insertion part; and the cap is disposed at the tip end of the insertion part by the dipping work covering the annular portion in the inner side away from a distal end of the insertion part past the annular portion, it is made possible to eliminate work for attaching the cap to the insertion part, providing in a short time the cap to the insertion part.

Furthermore, since the annular portion is formed by pressing the insertion part, it is made possible to reduce work for forming the annular portion, and thereby shortening of making the terminal, improving productivity.

DESCRIPTION OF EMBODIMENTS

Figure 1:
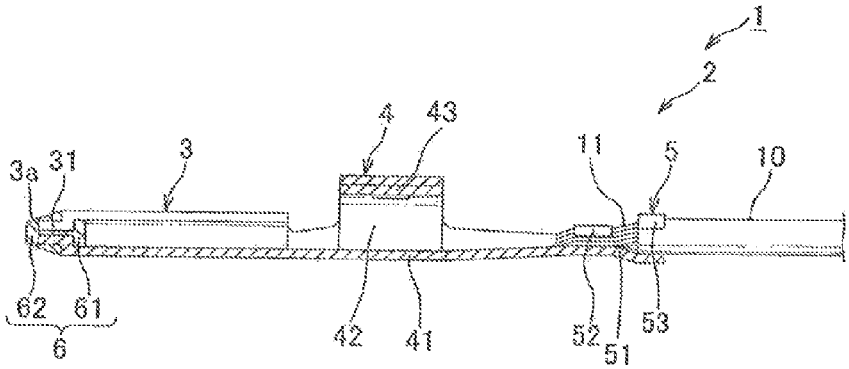
FIG. 1 is a perspective view illustrating a terminal according to one embodiment of the invention.

With reference to FIGS. 1 to 6 a terminal according to one embodiment of the present invention is described. A terminal 1, as shown in FIG. 1, composes wire harness to be wired in an electric vehicle. The wire harness is provided with an electric wire 10, and a connector (not shown) to be attached to an end of the electric wire 10. The connector is provided with a terminal 1 that includes a terminal fitting 2 to be connected to the electric wire and a cap 6 disposed to a tip of the terminal fitting 2, and a housing (not shown) that includes a terminal housing (not shown) arranged to receive the terminal 1. The housing is made of synthetic resin.

The forgoing terminal fitting 2 is provided with an insertion part 3 to be connected to a mating female terminal fitting (not shown), a housing attachment 4 continuous to the insertion part 3, and an electric wire connection part 5 continuous to the housing attachment 4 and to be connected to the electric wire 10. The terminal fitting 2 is made as by punching or bending metal plate.

This terminal fitting 2 is, while the electric wire connection part 5 is connected to the electric wire 10, inserted from the insertion part 3 into the terminal housing of the housing. Also, the terminal fitting 2 is inserted from the insertion part 3 into the mating female terminal fitting so as to be electrically connected to the mating terminal fitting. Also, the terminal fitting 2 is provided with a cap 6 at a tip end of the insertion part 3 that is made of insulating synthetic resin.

Figure 2:
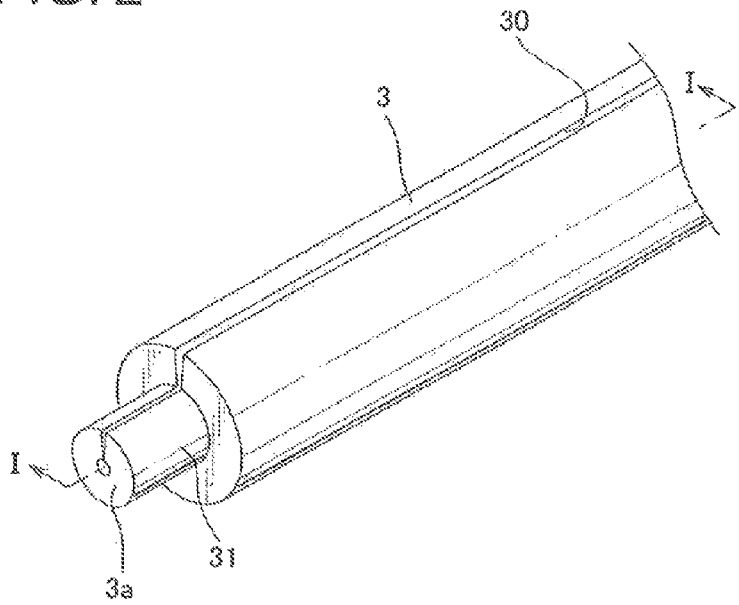
FIG. 2 is a perspective view illustrating a configuration of the terminal shown in FIG. 1.

The forgoing insertion part 3 is, as shown in FIG. 2, is made by rolling punched metal plate. Namely, the insertion part 3 is formed into a cylindrical shape by both ends of the punched metal plate approaching to each other and being overlaid with each other. Thereby, between the ends of the metal plate approaching to each other a slit 30 is formed from one end to the other end of the insertion part 3 in a length direction.

Figure 3:
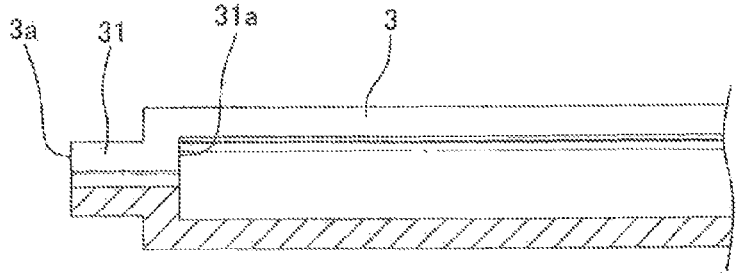
FIG. 3 is a cross-sectional view along I-I line in FIG. 2.

The insertion part 3 is, as shown in FIG. 3, provided at its tip end with an annular portion 31 of which diameter is reduced less than the insertion part 3. The foregoing annular portion 31 is shaped annular by pressing radially the insertion part 3. This annular portion 31 projects from inside the insertion part 3 in an inner direction approaching to each other. Also, the annular portion 31 projects from the insertion part 3 in the length direction of the insertion part 3.

The foregoing housing attachment part 4 is, as shown in FIG. 1, formed into a square tube shape by a bottom wall 41, a pair of side walls 42 upstanding from both ends of the bottom wall 41 in a width direction, a ceiling wall 43 coupling the pair of side walls 42. The bottom wall 41 and the pair of side walls 42 continues to the foregoing insert electric wire 10, a pair of core wire crimp pieces 52 upstanding from both ends of the base wall 51 in a width direction and crimping the core wire 11 of the electric wire 10, and a pair of insulating cover crimp piece 53 upstanding from both ends of the base wall 51 in a width direction and crimping an insulating cover of the electric wire 10. The foregoing base wall 51 is formed into a cross-sectional arc gutter shape. The pair of core wire crimp piece 52 is disposed nearer to the housing attachment part 4 than the pair of insulating cover crimp piece 53.

The electric wire connection part 5 is electrically connected to the electric wire such that an end thereof is peeled, the cross-sectional circular electric wire 10 with a core wire 11 exposed is placed on the base wall 51, and then the core wire crimp piece 52 is bent in such a direction that the core wire portion 11 of the electric wire 10 is pressed toward the base wall 51, namely, the core wire 11 is crimped by the core wire crimp piece 52. Likewise, the insulating cover crimp piece 53 is bent in such a direction that the cover of this electric wire 10 is pressed toward the base wall 51, namely the insulating cover portion is crimped by the insulating cover crimp piece 53 to be fixed to the electric wire.

Figure 4:
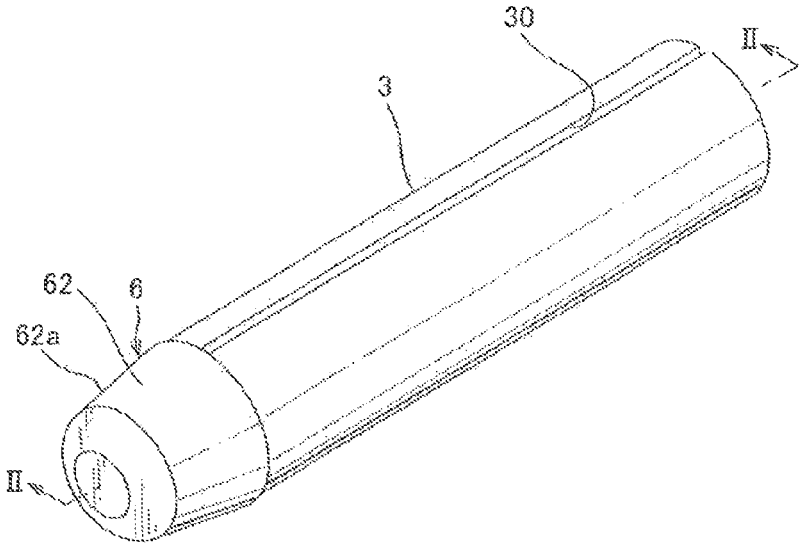
FIG. 4 is a perspective view of main part of the terminal shown in FIG. 1.
Figure 5:
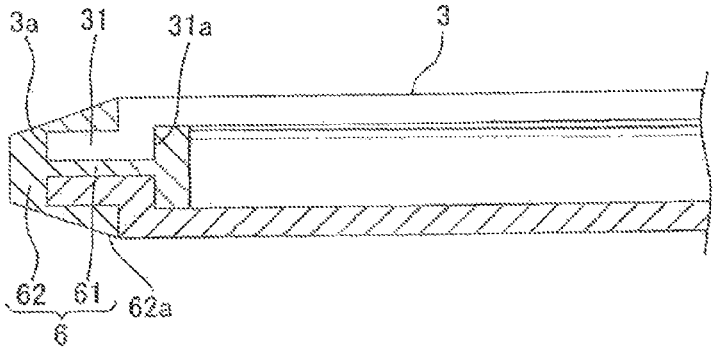
FIG. 5 is a cross-sectional view along II-II line in FIG. 4.

The foregoing cap 6 is, as shown in FIGS. 4 and 5, an embedded part 61 embedded inside the insertion part 3, and an exposed ion part 3 away from the annular part 31.

The forgoing connection part is provided with a base wall 51 continues to the bottom wall 41 and positioning thereon the part 62 exposed to outside insertion part 3 The embedded part 61 is disposed inside the annular part 31, and inside a part where the annular portion 31 of the insertion part 3 is not disposed. Namely, the embedded part 61 is arranged from the tip end 3*a* of the annular portion 31, i.e., the tip end 3*a* of the insertion part 3, toward the housing attachment 4 beyond the annular portion 31. This allows the part of the embedded part 61 nearer to the housing attachment part 4 than the annular portion 31 to abut onto an end face 31*a* (shown in FIG. 5) even when the cap 6 is pulled in a direction away from the terminal fitting 2, preventing the cap 6 from dropping from the terminal fitting 2.

The forgoing exposed part 62 covers the annular portion 31. Also, the exposed part 62 is provided with a tapered face 62*a*. The tapered part 62*a* continues to an outside of the insertion part 3, and is slanted in a direction in which a diameter of the insertion part 3 is reduced as away from the terminal 1. Provision of the tapered face 62*a* allows an insertion force to be reduced when the terminal 1 is inserted into the mating terminal fitting and the terminal housing of the housing.

Figure 6A:
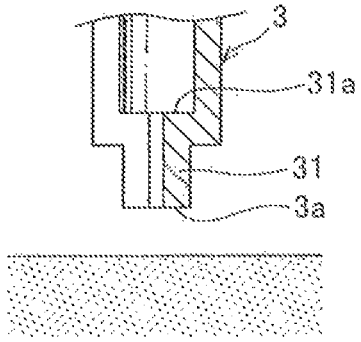
FIG. 6A is a view illustrating a state forming a cap to the terminal fitting shown in FIG. 2.
Figure 6B:
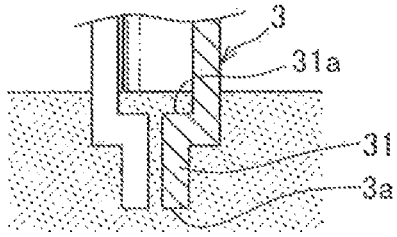
FIG. 6B is also a view illustrating a state forming a cap to the terminal fitting shown in FIG. 2.
Figure 6C:
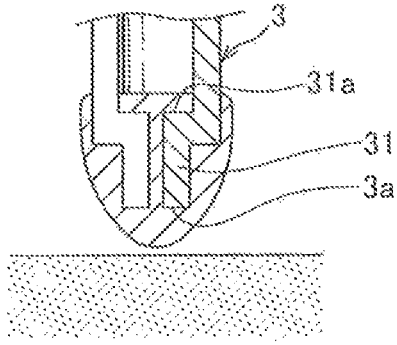
FIG. 6C is also a view illustrating a state forming a cap to the terminal fitting shown in FIG. 2.
Figure 6D:
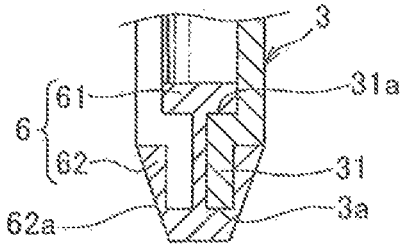
FIG. 6D is also a view illustrating a state forming a cap to the terminal fitting shown in FIG. 2.
Figure 7:
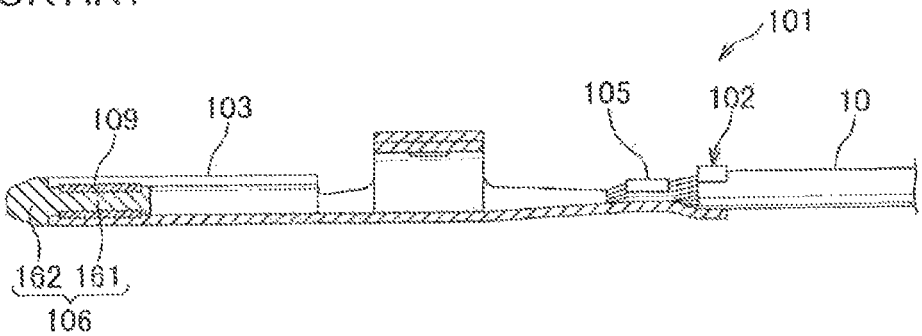
FIG. 7 PRIOR ART
FIG. 7 is a cross-section view illustrating a conventional terminal.
Figure 8:
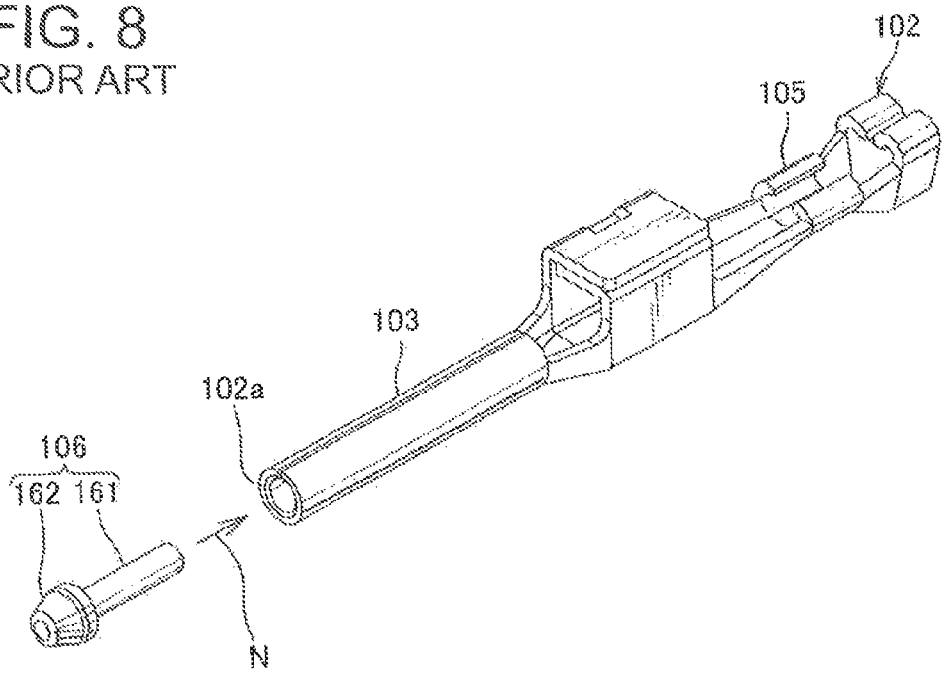
FIG. 8 PRIOR ART
FIG. 8 is exploded perspective view illustrating the terminal shown in FIG. 7.

Then, with reference to FIGS. 6A to 6D a method of forming the cap 6 of the terminal 1 configured as mentioned above is discussed. First, preliminary, the insertion part 3 is formed by punching and rolling a metal plate, and the annular portion 31 is formed at the end of the insertion part 3 by pressing. As shown in FIGS. 6A and 6B, thermoplastic resin is heated in a metal container to melt, and the insertion part 3 is dipped in the melted thermoplastic resin from near the tip end 3*a* of the insertion part 3 toward the housing attachment part 4 past the annular portion 31. Then, as shown in FIG. 6C, the terminal fitting 2 is drawn up from the melted thermoplastic in the container, and the thermoplastic resin is cured by cooling. Lastly, as shown in FIG. 6D, pads outside the insertion part 3, i.e., thermoplastic resin outside the insertion part 3, is removed, for example, by scraping in a tapered shape, so as to form the tapered face 62*a*. Otherwise, the tapered face 61*a* may be formed by its own weight of the thermoplastic resin. Thus the cap is formed.

The cap 6 may be, otherwise, formed using thermoset resin which is cured by heating. In the case, the insertion part 3 is dipped in the thermoset resin which lies in liquid at room temperature from near the tip end 3*a* of the insertion part 3 toward the housing attachment part 4 past the annular portion 31. Then, the terminal fitting 2 is drawn up from the melted thermoplastic in the container, and the thermoplastic resin may be cured by heating using such a heater.

According to the foregoing embodiment since the insertion part 3 is provided with the annular portion 31 of which the diameter is smaller than the insertion part 3 at the tip end thereof, the cap 6 is disposed to the insertion part 3 by dipping covering the annular portion 31 inwardly away from the tip end of the insertion part 3 past the annular portion 31, it is made possible to eliminate work for attaching the cap 6 to the insertion part 3, and to provide in a short time the cap 6 to the insertion part 3.

Furthermore, since the annular portion 31 is formed such that the insertion part 3 is pressed, it is made possible to reduce work for forming the annular portion 31, and thereby to shorten making of the terminal 1, improving productivity.

Note that in the foregoing embodiment, the annular portion 31 projects such as, but not limited to, from the insertion part 3 in its length direction, but may not project in the length direction as far as projecting in an inward direction approaching to each other.

The aforementioned embodiments merely show such as, but not limited to, typical embodiment of the present invention. Namely, it is to be understood that various changes and modifications will be apparent to those skilled in the art. Therefore, unless otherwise such changes and modifications depart from the scope of the present invention hereafter defined, they should be construed as being included therein.

REFERENCE SIGNS LIST

1 terminal
3 insertion part
3*a* tip end of insertion part
6 cap
31 annular portion

The invention claimed is:

1. A terminal, comprising:

a tubular insertion part including an annular portion disposed at a tip end of the insertion part, with outer and inner diameters smaller than outer and inner diameters of the insertion part, respectively, and a resin made cap disposed at the tip of the insertion part by a dipping work, wherein the cap is provided with an embedded part embedded inside the insertion part, and an exposed part covering the annular portion, and wherein the embedded part is disposed within the insertion part from a tip end of the annular portion past the annular portion, and wherein the annular portion is formed by pressing the insertion part radially.

2. A method of forming a cap of a terminal, comprising the steps of:

providing an annular portion with outer and inner diameters smaller than outer and inner diameters of an insertion part, respectively, the annular portion disposed at a tip end of the insertion part; and dipping the insertion part into a liquid resin from the tip end of the insertion part past the annular portion, wherein the annular portion is formed by pressing the insertion part radially.

* * * * *